United States Patent [19]

Wentworth

[11] 3,981,489

[45] Sept. 21, 1976

[54] AUTOMATIC HEAT TREATING SYSTEM

[75] Inventor: Hobart L. Wentworth, Barrington, Ill.

[73] Assignee: Sola Basic Industries, Inc., Milwaukee, Wis.

[22] Filed: Sept. 19, 1974

[21] Appl. No.: 507,445

Related U.S. Application Data

[63] Continuation of Ser. No. 322,716, Jan. 11, 1973, abandoned.

[52] U.S. Cl. ..... 266/80

[51] Int. Cl.[2] ..... C21D 1/66

[58] Field of Search ..... 266/4 R, 4 A, 80; 432/121; 214/18.24, 83

[56] References Cited

UNITED STATES PATENTS

| | | | |
|---|---|---|---|
| 2,847,203 | 8/1958 | Ferguson | 266/4 R |
| 2,977,107 | 3/1961 | Mescher | 266/4 R |
| 2,998,237 | 8/1961 | Coriolis et al. | 266/4 R |
| 3,031,881 | 5/1962 | Thorson | 148/16 X |
| 3,662,996 | 5/1972 | Schwalm et al. | 266/4 A |

*Primary Examiner*—Roy Lake
*Assistant Examiner*—Craig R. Feinberg
*Attorney, Agent, or Firm*—Smythe & Moore

[57] ABSTRACT

A material heat treating system having a plurality of integral quench furnaces and means to convey material to be treated thereto in a selected pattern operated by controllers into which selected patterns of treatment are fed. The controllers feed signals to a selected furnace to control operation thereof in a selected manner and also provide signals to control movement to, from and through the system in accordance with a selected program.

3 Claims, 3 Drawing Figures

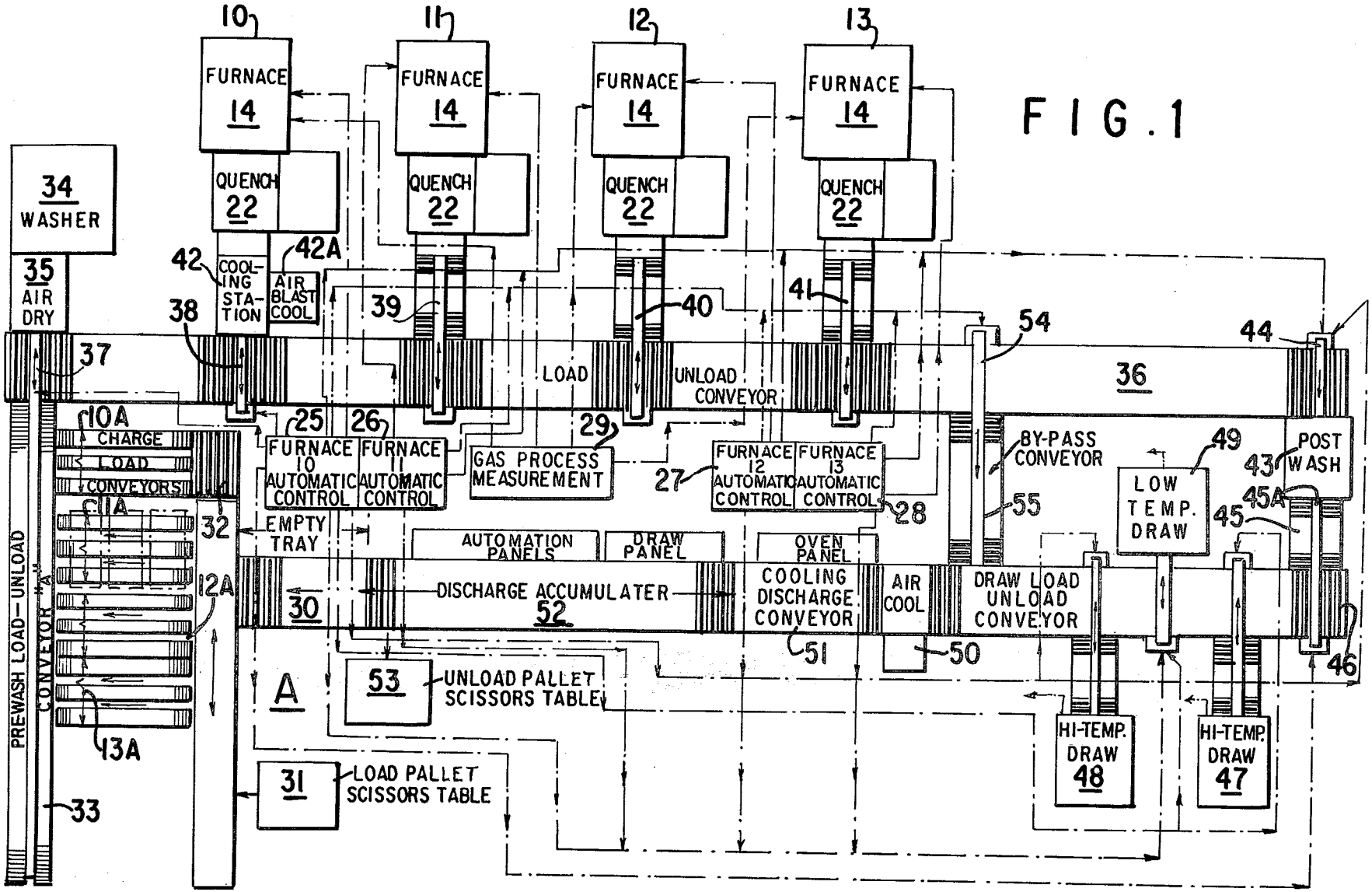
FIG. 1
FURNACE 14
QUENCH 22
COOLING STATION
AIR BLAST COOL
WASHER 34
AIR DRY 35
LOAD
UNLOAD CONVEYOR
FURNACE 10 AUTOMATIC CONTROL
FURNACE 11 AUTOMATIC CONTROL
FURNACE 12 AUTOMATIC CONTROL
FURNACE 13 AUTOMATIC CONTROL
GAS PROCESS MEASUREMENT
EMPTY TRAY
AUTOMATION PANELS
DRAW PANEL
OVEN PANEL
DISCHARGE ACCUMULATER
COOLING DISCHARGE CONVEYOR
AIR COOL
DRAW LOAD UNLOAD CONVEYOR
BY-PASS CONVEYOR
LOW TEMP. DRAW
POST WASH
HI-TEMP. DRAW 47
HI-TEMP. DRAW 48
UNLOAD PALLET SCISSORS TABLE
LOAD PALLET SCISSORS TABLE
CHARGE
LOAD
CONVEYORS
CONVEYOR "A"
PREWASH LOAD—UNLOAD

AUTOMATIC HEAT TREATING SYSTEM

This is a continuation of application Ser. No. 322,716, filed Jan. 11, 1973, now abandoned.

This invention relates to material heat treating systems and particularly to one wherein the treatment can be selected so as to provide automatic control.

In the heat treatment of materials, it is desirable to provide an infinite variety of cycles of operation in a manner that is simple to operate. Such systems are elaborate and have not been completely satisfactory in the past, especially because of inflexibility thereof.

One of the objects of the invention is to provide a material heat treating system which can be used for a large variety of different cycles.

In one aspect of the invention, there are a plurality of integral heating and quenching furnaces for receiving the material to be treated and to be operated in a selected manner. The selected furnace has had signals sent thereto in accordance with a predetermined changeable program, the program controlling transfer of the work to the furnace and therefrom. Conveyor means receives the material and transports it through washing means if needed, and then to the selected furnace where it is treated according to the selected program. After completion of the treatment, the automatic control means for the particular chosen cycle operates to move work out of the furnace and onto a conveyor means for transfer to other treating operations, such as a draw furnace. If desired, the draw furnace can be bypassed and the work delivered to an unloading zone. A card or tape operated controller or computer channels in one or more computer means is provided for each furnace which will cause movement of the material from the loading point at a programmed time through the washer to a position adjacent the furnace in time for loading therein as soon as the prior load has had the operation finished and is moved out of the furnace to a subsequent position. A controller controls the internal operation of the furnace as well as the movement of the work to the furnace and subsequent movement therefrom, the controller being operated by a program means, such as a punch or "clip" card or magnetic tape. A "clip" card is a card having channels therein, clipped or cut to the proper lengths for each of the operations or conditions to be controlled.

Other objects, advantages and features of the present invention will become apparent from the accompanying description and drawings, which are merely exemplary.

In the drawings:

FIG. 1 is a plan schematic view of one form of the invention;

Where appropriate, the same reference numerals are used on the various figures for the same parts.

One form of the invention will be described wherein there are four integral quench furnaces 10, 11, 12 and 13, each including a heating portion and a quench portion. Various types of such quench and heating or integral quench furnaces can be used, one type being described in detail hereafter.

Figure 2:
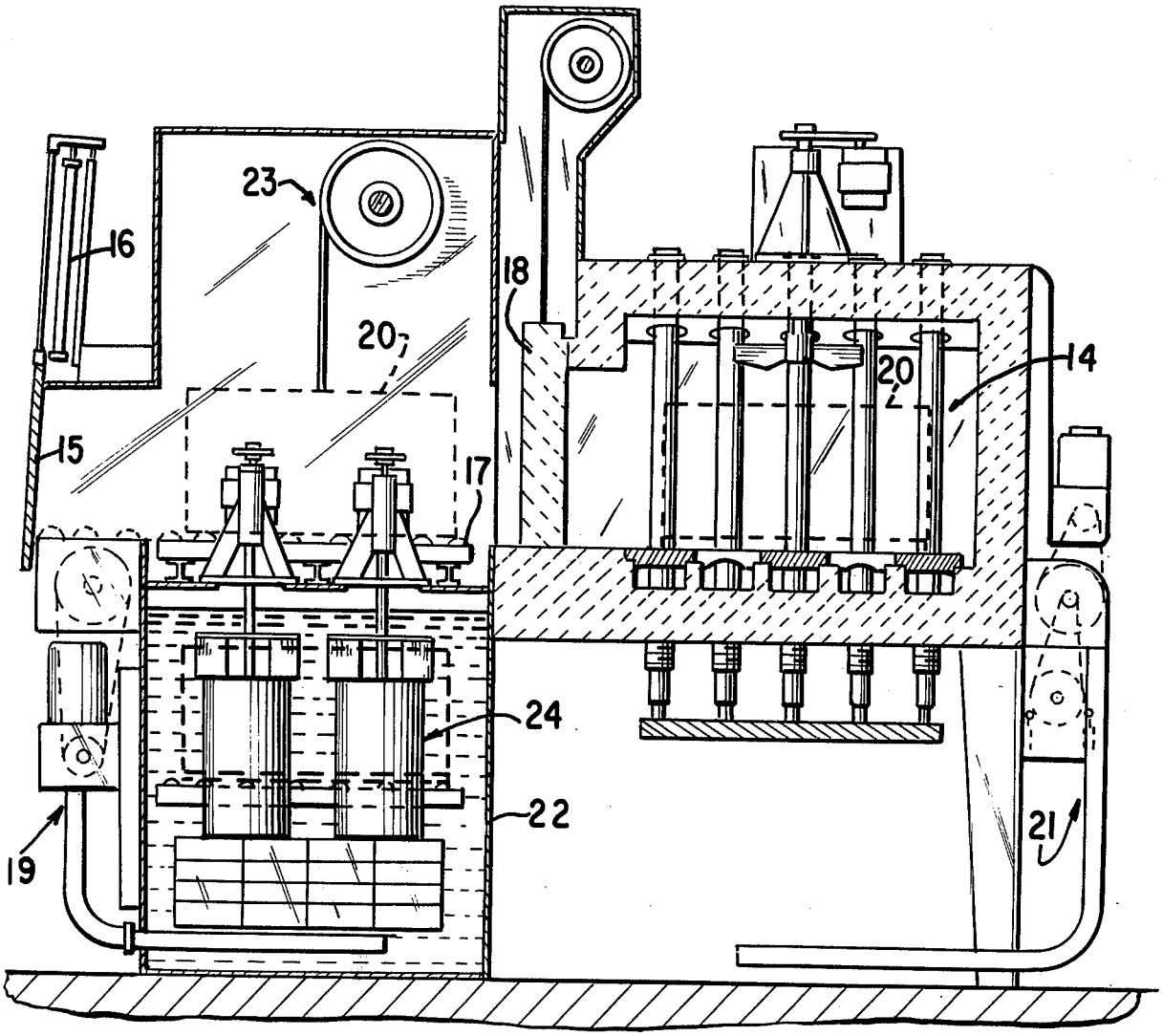
FIG. 2 is a side view of one of the heating and quench furnaces.

Referring to FIG. 2, heating portion 14 has usual heating elements or means and means for supplying the selected controlled atmosphere and providing the cycle control thereto. Such atmosphere and cycle will be in accordance with whether or not there is to be gas carburizing, carbon nitriding, or neutral hardening including the integral quenching furnace operation. Other optional equipment could be provided for normalizing, atmosphere quench hardening, etc.

The integral quench furnace has an entrance door 15 which is automatically operable by fluid-operated cylinder 16. The door can be opened upon signal and work pushed onto the raisable and lowerable table 17, the work being pushed thereon by conveyor means as will be described hereafter. The load then can be moved into the heating chamber 14 after door 18 has been raised. Such movement can be accomplished by a suitable furnace charge pusher 19.

When the doors are closed, the load 20 is heated to the desired temperature cycle and selected atmosphere by the automatic control, as is known in the art. Upon completion of the heating operation, door 18 is raised and the load moved back onto table 17 by the discharge pusher shown schematically at 21. The table 17 then can be lowered into the quench tank 22 which is filled with oil or coolant, the lowering mechanism 23 being automatically operated. The usual oil circulating pump means 24 can be provided.

A furnace automatic control, shown schematically at 25, is provided for furnace 10. Furnace automatic controls 26, 27, 28 are provided for integral quench furnaces 11, 12 and 13, respectively.

The furnace automatic control means can take various desired forms, one example of which is the automatic control means sold under the trademark "Robotrol," a trademark of Sola Basic Industries, Inc. Punch cards, "clip" cards or magnetic tape means can be used for selecting the desired sequence of operations in a furnace, including movement of the material from the main loading area to the furnace and subsequent operations. Inasmuch as the specific form thereof is not part of the invention, a detailed description is not necessary. As an example, the card or tape can transmit the following data to the control means for the furnace:

Gas analyzer range
Gas analyzer % $CO_2$ for time No. 1 (carburizing)
Gas analyzer % $CO_2$ for time No. 2 (diffusing)
Gas analyzer % $CO_2$ for time No. 3 (drop temperature)
Temperature for time No. 1 and No. 2
Temperature for time No. 3
Time No. 1 (carburizing)
Time No. 2 (diffusing)
Time No. 3 (drop temperature)
Draw selection (high or low)

In order to measure the atmosphere conditions in a furnace, various types of gas process atmosphere control systems can be employed. One of these is sold under the trademark "Carbotrol," a trademark of Sola Basic Industries, Inc., for its gas analyzer and control system. Such an analyzer or system senses minute quantities of the component present in the gas stream. The analyzer can be sensitized to respond to $CO_2$, $CH_4$, $NH_3$ or water vapor, depending upon the application. The gas to be sampled is passed through a sample cell in which a beam of infrared light is used. As is known, the sample gas absorbs some of the energy which creates a change in a signal which can be set to operate suitable indicating, recording and controlling devices. One such a measurement and control instrument is schematically shown at 29 which is arranged to have a multipoint configuration to serve each of the furnaces 10, 11, 12 and 13. The details of the atmosphere control system are not part of the invention so the foregoing description is all that is necessary.

Referring to FIG. 1, the loading and unloading area is at zone A, empty trays accumulating at 30. A load pallet scissors table means 31 or other type of table is arranged to load trays with material to be processed onto a table 32 which is movable as needed along the charge load conveyors 10A, 11A, 12A and 13A, these conveyors serving to receive materials for the respective integral quench furnaces 10, 11, 12 and 13. As shown, each of the charge load conveyors can receive as many as three trays together and has an automatically activated operated pusher for selectively pushing a tray onto a first conveyor which can be termed a pre-wash load-unload conveyor 33. Conveyor 33 has chain-actuated pusher heads for moving the work in and out of the washer 34 and the dryer 35. An example of such a pusher head is shown in U.S. Pat. No. 2,965,369. Other types, of course, can be used. Trays are delivered therefrom into load washer 34 and dryer 35 where the load can be washed, dried and then returned to the second main furnace load-unload conveyor 36 by pusher head 37. Conveyor 36 can comprise driven rolls as is known in the art.

If the pre-washer 34, 35 is not to be used, the tray will be picked up by conveyor 36 and moved to the right until stopped by automatically operated or movable detents (not shown). Each of the furnaces 10, 11, 12 and 13, respectively, has a loading pusher and unloader means 38, 39, 40, 41. Each of the loader-unloader pushers is automatically activated, as will be explained hereafter, in accordance with signals from the furnace automatic control for the particular furnace concerned.

Describing now the operation of furnace 10, which is arranged for annealing, the work is first moved onto a table or station 42, having an air blast cooling means 42A, and then into the furnace 10 as described for FIG. 2. As an example, furnace 10 can be arranged to include and to have a normalizing cycle. Upon completion of the operation, the load is returned to the cooling station 42 if it is to be cooled at this point, and then back onto conveyor 36. The other furnaces do not necessarily have an air blast cool station 42A. Detent or latch means can be used at appropriate places in conjunction with conveyor 36 to automatically stop a tray thereon before it is moved to a position to be pushed into a furnace.

After a tray has been returned nd moved onto conveyor 36 and is to be subjected to further operation, including washing in accordance with an automatic control signal, it will be moved to a point in front of the post washer 43. It is then pushed by pusher means 44 into the washer, retained therein for the preselected time, and then moved by the pusher onto conveyor 45 to the load and unload conveyor 46. The tray is then moved along conveyor 46 until it is stopped in front of the selected high temperature draw oven 47, 48 or the low temperature draw oven 49 to which it is to be moved as called for by the automatic control. After completion of the draw operation, the tray or material is again moved back onto conveyor 46 and is carried through the cool or final cool zone 50 and then to the cooling discharge conveyor means 51 and onto the discharge accumulator conveyor arrangement 52 from which it can be unloaded onto a scissors table or unload pallet 53.

Describing now a cycle of operation, when material or work to be heated enters the heat treating zone A with lubricant from previous machining operations, and possibly some dirt and metal chips, it is necessary to wash the work. When work is moved into the pre-wash washer 34, a wash timer is started by such a movement. After the wash timer times out, the work is pushed from the washer 34 into the dryer 35 where a dryer timer starts. After the dryer timer times out, the work continues to stay in the dryer waiting for the selected appropriate furnace to be ready to receive the load.

Movement of a loaded tray of work from one of the load feed tables 10A, 11A, 12A or 13A occurs upon demand of the specific furnace involved providing the washer and drying mechanism 34, 35 is empty which will simultaneously lock out the other load feed tables until again empty. Conveyor 33 is aranged to charge the pre-wash through the dryer and to later push work from the dryer.

The system is arranged to anticipate a call from a furnace for a tray by approximately one-half hour so as to allow the tray to be moved from the specific load feed table in time to pre-wash and dry and await the actual signal that the furnace has discharged a tray and the tray has cleared conveyor 36.

As the signal for a new tray is received, the tray waiting in the dryer 35 is moved onto conveyor 36 by a reverse pusher head on conveyor 33.

Conveyor 36 then conveys the tray on driven rollers until it is in front of the load table for the specific furnace corresponding to the load feed table from which the tray started.

At this point, a tray stop or detent will have been previously raised between the rolls of conveyor 36. The stop also has a limit switch to stop conveyor 36 rolls as the tray contacts the physical stop.

The conveyor 36 cross chain pusher-puller head 38, 39, 40, 41 in a push mode will push the tray onto the load table in front of the furnace.

When a tray is ready for discharge after quench oil drain, the furnace conveyor cross chain (38, 39, 40, 41) in pull mode hooks the tray and pulls it onto conveyor 36 where it is conveyed by the driven rolls to the end of conveyor 36.

If the post washer is empty, the work will be moved by pusher 44 into the post washer 43. As the tray leaves the furnace, the system has its draw temperature requirements signalled from the control card.

After the post wash operation, the tray will remain in washer 43 until a draw furnace of appropriate temperature is available, at which time the washer charge pusher 45A will push the tray onto conveyor 46. Upon reaching conveyor 46, the tray will travel on driven rolls until it strikes a physical stop-limit switch gate (not shown) raised in front of the appropriate draw oven 47, 48 or 49 where the cross pusher-puller in push mode will transfer the tray to the draw oven. Following the draw operation, the pusher-puller will in pull mode transfer the tray back to conveyor 46 where it will be driven into the final cooler 50 where it will remain stationary until the cooling cycle has timed out.

As the load times out in cooler 50, the drive rolls start up along with those in following conveyor 51 to clear the cooler 50 and advance all trays on 51 with the last tray on 51 being pushed onto idler rolls of the following conveyor 52. Loaded trays leaving the driven conveyor 51 are accumulated on the idler conveyor 52. Unload scissors table 53 with a roller deck is located adjacent to the discharge conveyor 52. An unload operator unloads the work on the last tray onto conveyor 52 and onto scissors table 53. The operator then depresses the scissors table to place the top thereof at a convenient height for unloading.

As the load is built up in layers on the pallet, the operator lowers the stationary scissors table to maintain a convenient load height. After the tray is unloaded, the unload scissors conveyor is again raised to conveyor height and the empty tray moved onto a following idler conveyor section 30 for temporary accumulation.

If a post wash and draw is not needed, the card or controller involved can signal by-pass pusher 54 and stops (not shown) to transfer the work to by-pass conveyor 55 to transfer the work to the load-unload conveyor 46 for movement to the air cool station 50.

The signal connections from the various furnace controls are shown schematically, and various controllers, including relays, limit switches and timers, etc., are employed to carry out the various signalled operations. Dot-dash lines are used to indicate schematically some of the signal or control connections. The automatic control means are arranged to receive the punch or "clip" cards or the magnetic tape and carry it into or through the control means at a predetermined rate so as to provide the control signals to the various operating means of the system. The specific details of the signal connections and controls are known in the art and can be varied as needed. For example, various types of computers, including those employing solid state memory circuits, can be used.

Figure 3:
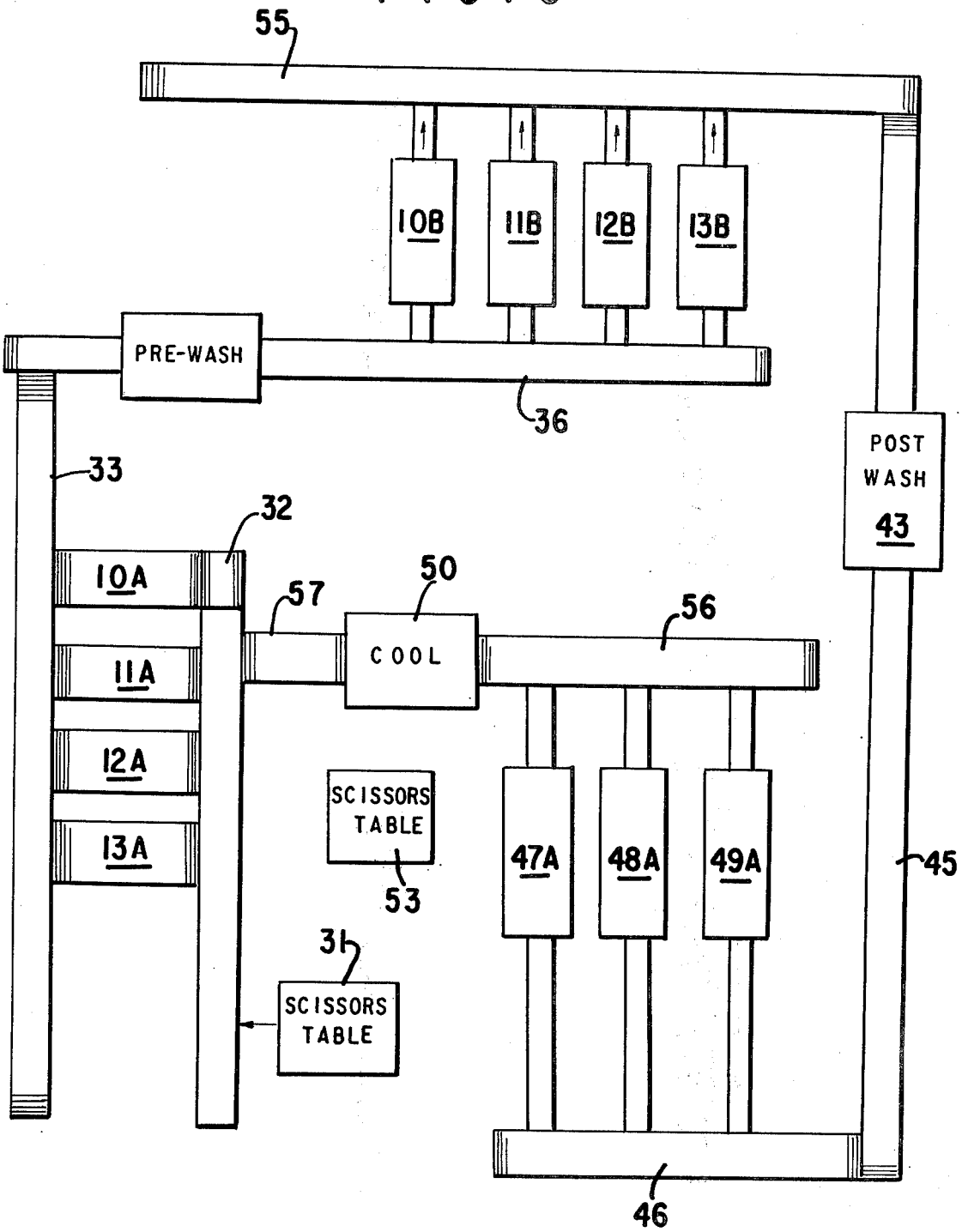
FIG. 3 is a plan schematic view of another form of the system.

Another form is shown in FIG. 3 wherein the work is moved in conjunction with straight-through equipment rather than in and out from one-end equipment, as shown in FIG. 2. Furnaces 10B, 11B, 12B and 13B are similar to those of FIG. 2 except that the work is moved into the furnace from conveyor 36 and then pushed out of the furnace onto conveyor 55, and thence through washer 43. Then it is moved onto conveyors 45, 46 to the selected draw ovens 47A, 48A and 49A, which are of the straight-through type, and onto conveyor 56 and into cooler 50. Conveyor 57 can be similarly arranged as are conveyors 51, 52 and 50 (FIG. 2).

The control means for FIG. 3 is similar to FIG. 2.

It is to be understood that the system is particularly useful in conjunction with a batch or continuous operation and that the details of construction can be varied without departing from the spirit of the invention except as defined in the appended claims.

What is claimed is:

1. In a material heat and treating furnace system, the combination including a plurality of material heating and quenching furnaces, first conveyor means for receiving material to be treated, second conveyor means located transversely along and adjacent said heating and quenching furnaces so that material to be treated in a selected furnace can be selectively received thereby, means for selectively moving material to be treated from said first conveyor means to said second conveyor means, an automatic temperature sensing, atmosphere sensing and operation control means for each of said furnaces, loading and unloading means for selectively transferring material to and from said second conveyor means to a selected one of said heating and quenching furnaces, an automatic computer control means for each furnace and connected to its automatic temperature atmosphere and control means, said computer control means being arranged to receive a selected pattern of treatment information for controlling signals therefrom and which in response to said signals will control said automtic temperature atmosphere and operation control means and will provide activating signals to the conveyor means to selectively move material in the selected pattern onto and from said first conveyor means to said second conveyor means and to a selected one of said heating and quenching furnaces, and which will activate the selected furnace for the preselected pattern of treatment in accordance with the treatment information to said computer control means when the material is moved into the selected furnace, the control means being activated for a selected furnace to transfer material thereto a predetermined time before the selected furnace is in readiness to receive the material, the material being first moved from the first conveyor means to a prewash and drying means and held there until the selected furnace is ready to receive the same, there being draw oven means, post wash means and cooling means to which the material is selectively moved by the automatic control means to which the material is selectively moved by the automatic control means after being treated in one of said furnace means, and a plurality of draw oven means and cooling means located along a third unload conveyor with a post wash means between said second conveyor and third conveyor and a by-pass conveyor between said second and third conveyors across which material can be selectively passed to by-pass said post wash and draw oven means.

2. In a material heat and treating furnace system, the combination including a plurality of material heating and quenching furnaces, first conveyor means for receiving material to be treated, second conveyor means located transversely along and adjacent said heating and quenching furnaces so that material to be treated in a selected furnace can be selectively received thereby, means for selectively moving material to be treated from said first conveyor means to said second conveyor means, an automatic temperature, atmosphere and operating control means for each of said furnaces, loading and unloading means for selectively transferring material to and from said second conveyor means to a selected one of said heating and quenching furnaces, and an automatic computer control means for each furnace into which a selected pattern of treatment information can be fed and which will in response thereto operate said automatic temperature atmosphere and operation control means for feeding activating signals to the conveyor means to selectively move material in a selected pattern onto and from said first conveyor means to said second conveyor means and to a selected one of said heating and quenching furnaces, and which will activate the selected furnace for a preselected pattern of treatment in accordance with the treatment information when the material is moved therein, the control means being activated for a selected furnace to transfer material thereto a predetermined time before the selected furnace is in readiness to receive the material, the material being first moved from the first conveyor means to a pre-wash and drying means and held there until the selected furnace is ready to receive the same, a plurality of draw oven means, post wash means and cooling means to which the material is selectively moved by the automatic control means after being treated in one of said furnace means, said plurality of draw oven means and said cooling means being located along a third unload conveyor with the post wash means between said second conveyor and third conveyor, and a by-pass conveyor between said second and third conveyors across which material can be selectively passed to by-pass said post wash and draw over means.

3. A material heat and treating furnace system as claimed in claim 2 wherein said second conveyor means comprises a conveyor at the inlet front side of the heating and quenching furnaces and a conveyor at the outlet rear side of the heating and quenching furnaces, the material to be treated passing through a furnace.

* * * * *